US010455319B1

(12) United States Patent
Wu et al.

(10) Patent No.: US 10,455,319 B1
(45) Date of Patent: Oct. 22, 2019

(54) REDUCING NOISE IN AUDIO SIGNALS

(71) Applicant: MOTOROLA MOBILITY LLC, Chicago, IL (US)

(72) Inventors: Jincheng Wu, Naperville, IL (US); Joel A. Clark, Woodridge, IL (US); Malay Gupta, South Elgin, IL (US); Plamen A. Ivanov, Schaumberg, IL (US)

(73) Assignee: Motorola Mobility LLC, Chicago, IL (US)

( * ) Notice: Subject to any disclaimer, the term of this patent is extended or adjusted under 35 U.S.C. 154(b) by 0 days.

(21) Appl. No.: 16/039,094

(22) Filed: Jul. 18, 2018

(51) Int. Cl.

| | |
|---|---|
| ***H04R 3/04*** | (2006.01) |
| ***G10L 21/0232*** | (2013.01) |
| ***H04R 1/22*** | (2006.01) |
| ***H04R 29/00*** | (2006.01) |
| *G10L 21/0216* | (2013.01) |

(52) U.S. Cl.
CPC ..... *H04R 1/222* (2013.01); *G10L 21/0232* (2013.01); *H04R 3/04* (2013.01); *H04R 29/005* (2013.01); *G10L 2021/02166* (2013.01)

(58) Field of Classification Search
CPC ..... G10L 21/0208; G10L 2021/02165; G10L 2021/02166; G10L 2021/02168; G10K 2210/3025; H04R 3/005; H04R 1/222; H04R 3/04
USPC ..... 381/17, 94.1, 107, 71.6, 94.2, 94.7, 95, 381/111; 704/226, 233, 231, E21.002
See application file for complete search history.

(56) References Cited

U.S. PATENT DOCUMENTS

2009/0063143 A1* 3/2009 Schmidt ..... G10L 21/0208 704/233
2010/0017205 A1* 1/2010 Visser ..... G10L 19/00 704/225
2012/0310637 A1* 12/2012 Vitte ..... G10L 21/0208 704/226
2013/0282373 A1* 10/2013 Visser ..... G10L 21/0208 704/233
2014/0278386 A1* 9/2014 Konchitsky ..... G10K 11/002 704/226
2014/0314238 A1* 10/2014 Usher ..... H04R 3/04 381/17

(Continued)

OTHER PUBLICATIONS

Tashev, Ivan et al., "Microphone Array for Headset With Spatial Noise Suppressor", Microsoft Research, pp. 1-4, Sep. 2005.

*Primary Examiner* — Vivian C Chin
*Assistant Examiner* — Friedrich Fahnert
(74) *Attorney, Agent, or Firm* — Yudell Isidore PLLC

(57) ABSTRACT

A method, a system, and a computer program product reducing noise in audio received by at least one microphone. The method includes determining, from an audio signal received by at least one primary microphone of an electronic device, whether a user that is proximate to the electronic device is currently speaking. The method further includes, in response to determining that a user is not currently speaking, receiving a first audio using a first microphone subset from among a plurality of microphones and receiving at least one second audio using at least one second microphone subset from among the plurality of microphones. The method further includes generating a composite signal from the first audio and the second audio. The method further includes collectively processing the audio signal and the composite signal to generate a modified audio signal having a reduced level of noise.

18 Claims, 6 Drawing Sheets

(56) References Cited

U.S. PATENT DOCUMENTS

| | | | | |
|---|---|---|---|---|
| 2015/0341006 | A1* | 11/2015 | Jiang | H03G 3/20 381/107 |
| 2017/0084288 | A1* | 3/2017 | Chatlani | G10L 21/0216 |
| 2018/0033447 | A1* | 2/2018 | Ramprashad | G10L 21/028 |

* cited by examiner

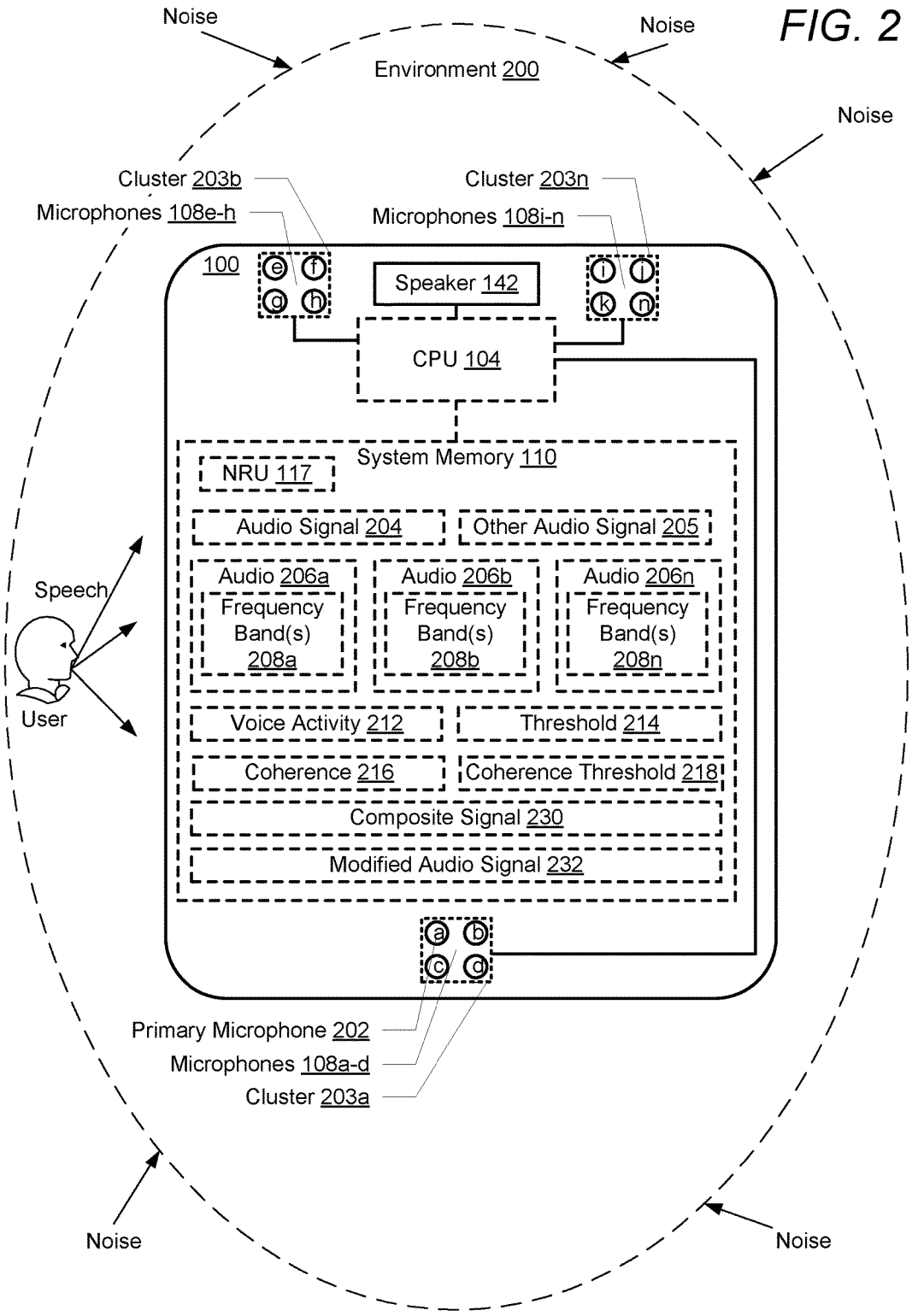
FIG. 2
Noise
Noise
Noise
Environment 200
Cluster 203b
Microphones 108e-h
Cluster 203n
Microphones 108i-n
100
e
f
g
h
Speaker 142
l
j
k
n
CPU 104
System Memory 110
NRU 117
Audio Signal 204
Other Audio Signal 205
Audio 206a
Frequency Band(s) 208a
Audio 206b
Frequency Band(s) 208b
Audio 206n
Frequency Band(s) 208n
Voice Activity 212
Threshold 214
Coherence 216
Coherence Threshold 218
Composite Signal 230
Modified Audio Signal 232
Speech
User
a
b
c
d
Primary Microphone 202
Microphones 108a-d
Cluster 203a
Noise
Noise

REDUCING NOISE IN AUDIO SIGNALS

BACKGROUND

1. Technical Field

The present disclosure generally relates to communication devices and in particular to a method for reducing noise received by a microphone.

2. Description of the Related Art

Many modern electronic devices include microphones for receiving audio. However, these microphones may receive background noise which may reduce the quality of the received audio for a listener. Some existing solutions analyze audio from a single microphone and filter background noise. However, these solutions sometimes reduce the quality of the audio by filtering audio in desired frequency ranges and/or introducing audible artifacts or speech distortion in the processed audio. Additionally, many of these solutions are only effective in cancelling stationary ambient (or background) noise and are ineffective in a mobile environment.

BRIEF DESCRIPTION OF THE DRAWINGS

The description of the illustrative embodiments is to be read in conjunction with the accompanying drawings. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which:

FIG. 2 illustrates additional functional components within an example electronic device, in accordance with one or more embodiments;

DETAILED DESCRIPTION

Figure 1:
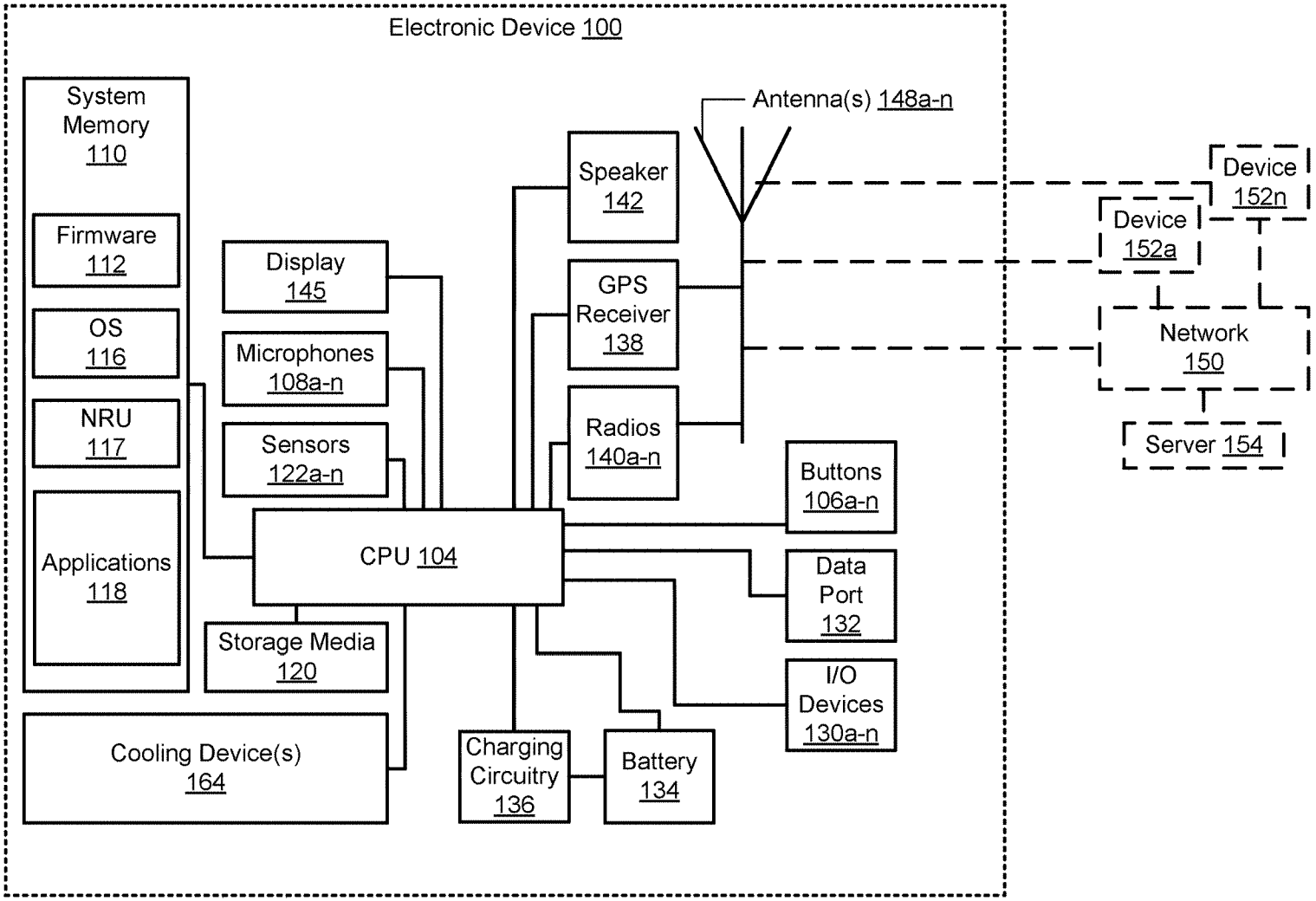
FIG. 1 illustrates an example electronic device within which certain aspects of the disclosure can be practiced, in accordance with one or more embodiments.

The illustrative embodiments provide a method, a system, and a computer program product for reducing noise in an audio signal received by at least one microphone. The method includes determining, from an audio signal captured by at least one primary microphone of an electronic device, whether a user that is proximate to the electronic device is currently speaking. The method further includes, in response to determining that a user is not currently speaking, capturing a first audio using a first microphone subset from among a plurality of microphones and capturing at least one second audio using at least one second microphone subset from among the plurality of microphones. The method further includes generating a composite signal from the first audio and the second audio. The method further includes collectively processing the audio signal and the composite signal to generate a modified audio signal having a reduced level of noise.

The above contains simplifications, generalizations and omissions of detail and is not intended as a comprehensive description of the claimed subject matter but, rather, is intended to provide a brief overview of some of the functionality associated therewith. Other systems, methods, functionality, features, and advantages of the claimed subject matter will be or will become apparent to one with skill in the art upon examination of the following figures and the remaining detailed written description.

In the following description, specific example embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from the general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various aspects are described which may be aspects for some embodiments but not other embodiments.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Moreover, the use of the terms first, second, etc. do not denote any order or importance, but rather the terms first, second, etc. are used to distinguish one element from another.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be provided its broadest interpretation given the context in which that term is utilized.

Those of ordinary skill in the art will appreciate that the hardware components and basic configuration depicted in the following figures may vary. For example, the illustrative components within the below described electronic device 100 (FIG. 1) are not intended to be exhaustive, but rather are representative to highlight components that can be utilized to implement the present disclosure. Other devices/components may be used in addition to, or in place of, the hardware depicted. The depicted example is not meant to imply architectural or other limitations with respect to the presently described embodiments and/or the general disclosure.

Within the descriptions of the different views of the figures, the use of the same reference numerals and/or symbols in different drawings indicates similar or identical items, and similar elements can be provided similar names and reference numerals throughout the figure(s). The specific identifiers/names and reference numerals assigned to the elements are provided solely to aid in the description and are not meant to imply any limitations (structural or functional or otherwise) on the described embodiments.

Now turning to FIG. 1, there is illustrated an example electronic device 100 within which one or more of the described features of the various embodiments of the disclosure can be implemented. In one embodiment, electronic device 100 can be any electronic device that is equipped with a plurality of microphones (e.g., microphones 108*a-n*). For example, electronic device 100 can include, but is not limited to including, a mobile/cellular phone, a tablet computer, a data processing system, a notebook computer, or a mobile/cellular phone accessory. Electronic device 100 includes central processing unit (CPU) 104. CPU 104 may be a single CPU containing one or a plurality of cores, each of which can be capable of independent processing, in one embodiment. In another embodiment, CPU 104 includes multiple CPUs. In another embodiment, CPU 104 may include a graphical processing unit (GPU), a general purpose graphical processing unit (GPGPU), and/or a digital signal processor (DSP). In another embodiment, electronic device 100 includes a GPGPU and/or DSP, as separate components from CPU 104. CPU 104 is coupled to storage media 120 and system memory 110, within which firmware 112, operating system (OS) 116, noise reduction utility (NRU) 117, and applications 118 can be stored for execution by CPU 104. According to one aspect, NRU 117 executes within electronic device 100 to perform the various methods and functions described herein. In one or more embodiments, NRU 117 reduces noise in received audio signals. For simplicity, NRU 117 is illustrated and described as a standalone or separate software/firmware/logic component, which provides the specific functions and methods described below. However, in at least one embodiment, NRU 117 may be a component of, may be combined with, or may be incorporated within firmware 112, OS 116, and/or within one or more of applications 118.

As shown, electronic device 100 may include input devices and output (I/O) devices 130*a-n* that enable a user to interface with device 100. Electronic device 100 can also include hardware buttons 106*a-n*, microphones 108*a-n*, and speaker 142. Microphones 108*a-n* can be used to receive spoken input/commands from a user. In one or more embodiments, microphones 108*a-n* include multiple subsets and/or arrays of microphones that are spatially separate, Hardware buttons 106*a-n* are selectable buttons which are used to receive manual/tactile input from a user to control specific operations of electronic device 100 and/or of applications executing thereon. In one embodiment, hardware buttons 106*a-n* may also include, or may be connected to, one or more sensors (e.g. a fingerprint scanner) and/or hardware buttons 106*a-n* may be pressure sensitive. Hardware buttons 106*a-n* may also be directly associated with one or more functions of a graphical user interface (not pictured) and/or functions of an OS (e.g., OS 116), an application (e.g., applications 118), or hardware of electronic device 100. In one embodiment, hardware buttons 106*a-n* may include a keyboard. Speaker 142 is used to output audio. In one embodiment, speaker 142 includes multiple speakers.

CPU 104 is also coupled to sensors 122*a-n* and display 145. Sensors 122*a-n* can include, but are not limited to including, at least one of: light sensors, infrared (IR) light sensors, thermal/temperature sensors, noise sensors, motion sensors and/or accelerometers, proximity sensors, and/or camera sensors. Display 145 is capable of displaying text, media content, including images and video, and/or a graphical user interface (GUI) associated with or generated by firmware and/or one or more applications executing on electronic device 100. CPU 104 can render the GUI for viewing by display 145, in one embodiment, or the GUI can be rendered by a GPU (not illustrated), in another embodiment. In one or more embodiments, display 145 is a touch screen that is also capable of receiving touch/tactile input from a user of electronic device 100, such as when the user is interfacing with a displayed (or partially displayed) GUI. In at least one embodiment, device 100 can include a plurality of virtual buttons or affordances that operate in addition to, or in lieu of, hardware buttons 106*a-n*. For example, device 100 can be equipped with a touch screen interface and provide, via a GUI, a virtual keyboard or other virtual icons for user interfacing therewith.

As shown, electronic device 100 also includes cooling device(s) 164. In one embodiment, cooling device(s) 164 include at least one passive cooling device for dissipating heat generated by at least one heat-generating component of electronic device 100 to an environment of electronic device 100. Passive cooling devices may include a heat sink, for example. In another embodiment, cooling devices 164 includes at least one active cooling device that is used to cool at least one heat-generating component of electronic device 100 and transfer heat generated by the at least one component to a surrounding environment, external to electronic device 100. Active cooling devices can include, but are not limited to: thermoelectric cooling devices, electromagnetic cooling devices, oscillatory cooling devices, forced liquid cooling devices, and/or forced air/gas cooling devices, such as radial/rotary fans and blowers. Active cooling devices can include motors and/or moving components that generate air-based noise and/or mechanical/vibrational noise which may be audible to a user of electronic device 100.

Electronic device 100 also includes data port 132 (e.g., a universal serial bus (USB) port), battery 134, and charging circuitry 136. Data port 132 can operate as a charging port that receives power via an external charging device (not pictured) for charging battery 134 via charging circuitry 136. Data port 132 can also operate as a charging port that provides power to an external device that is connected to data port 132 for charging a battery (not pictured) of the external device via charging circuitry 136. Battery 134 may include a single battery or multiple batteries for providing power to components of electronic device 100. In at least one embodiment, battery 134 includes at least one battery that is removable and/or replaceable by an end user. In another embodiment, battery 134 includes at least one battery that is permanently secured within/to electronic device 100. Data port 132 may also function as one of an input port, an output port, and a combination input/output port.

Electronic device 100 may also include global positioning satellite (GPS) receiver 138 and one or more wireless radios 140*a-n*. GPS 138 may be coupled to at least one of antenna(s) 148*a-n* to enable electronic device 100 to determine its current location and/or rate of travel. Wireless radios 140*a-n* may be coupled to one or more of antenna(s) 148*a-n* to enable electronic device 100 to wirelessly connect to, and transmit and receive voice and/or data communication to/from, one or more other devices, such as devices 152*a-n* and server 154. As a wireless device, device 100 can transmit data over a wireless network 150 (e.g., a Wi-Fi network, a cellular network, a Bluetooth® network (including Bluetooth® low energy (BLE) networks), a wireless ad hoc network (WANET), or a personal area network (PAN)). In one embodiment, wireless radios 140*a-n* may include a short-range wireless device, including, but not limited to, a near field communication (NFC) device. In one embodiment, electronic device 100 may be further equipped with an infrared (IR) device (not pictured) for communicating with other devices using an IR connection. In another embodiment, electronic device 100 may communicate with one or more other device(s) using a wired or wireless USB connection.

FIG. 2 is a block diagram illustrating additional functional components within example electronic device 100, in accordance with one or more embodiments of the present disclosure. As illustrated, electronic device 100 includes CPU 104, which executes NRU 117 stored in a memory (e.g., system memory 110). Electronic device 100 also includes system memory 110, microphones 108*a-n*, and speaker 142. In the illustrated embodiment of FIG. 2, microphones 108*a-n* are arranged as microphone clusters 203*a-n* which include four microphones each. In other embodiments, microphones 108*a-n* may be arranged in microphone clusters of other sizes. In one or more embodiments, microphones within a same microphone cluster are arranged/aligned to be physically proximate but are not necessarily on a same side and/or edge of electronic device 100. Microphone clusters 203*a* can be positioned/arranged on any surface of electronic device 100. In one or more embodiments, each microphone within a cluster 203*a-n* is aligned/arranged to receive audio in a different direction. While three microphone clusters are illustrated, it should be noted that in other embodiments, electronic device 100 can include two microphone clusters or additional (i.e., more than 3) microphone clusters. It should also be noted that microphones 108*a-n* can also include individual microphones that are not arranged in a cluster.

In order to reduce noise in audio signals received from microphones 108*a-n*, CPU 104 first determines primary microphone 202. In one embodiment, primary microphone 202 is a pre-determined physical microphone from among microphones 108*a-n* from which audio signal 204 is received. In this embodiment, primary microphone 202 may be predetermined by a manufacturer and/or vendor associated with electronic device 100. In another embodiment, primary microphone 202 may be selected by a user of electronic device 100. In another embodiment, primary microphone 202 is a virtual microphone that is formed when CPU 104 collectively processes audio simultaneously received by two or more microphones. In another embodiment, electronic device 100 receives, via an input device (e.g., I/O devices 130*a-n*) a selection that identifies primary microphone 202 from a user of electronic device at the beginning of a communication, such as a cellular call or voice over internet protocol (VOIP) call. In another embodiment, selection of primary microphone 202 can be performed multiple times during a call if significant changes are detected in a level of ambient noise within environment 200. The selection of primary microphone 202 can be based on coherence measurements between microphones 108*a-n*, as described in greater detail below. In another embodiment, selection of primary microphone 202 may occur manually or automatically based on CPU 104 and/or at least one sensor of electronic device 100 detecting a usage change of electronic device, such as reconfiguring electronic device to utilize a speakerphone mode instead of a headset mode.

Primary microphone 202 receives audio signal 204 in environment 200. Audio signal 204 is a real-time audio that includes any noise, such as speech and/or background noises, in range of primary microphone 202 within environment 200. For example, audio signal 204 may include, speech spoken by a user of electronic device 100 and/or background noise, which can include wind noise, noise generated by objects and/or persons in environment 200 (e.g., speech spoken by other persons in environment 200). CPU 104 analyzes audio signal 204 to determine whether a user that is proximate to the electronic device is currently speaking. In one embodiment, CPU 104 analyzes audio signal 204 to determine voice activity 212. In one or more embodiments, voice activity 212 represents a level and/or measurement of voice activity (e.g., a volume of speech) within at least one particular frequency band/range. In one embodiment, the at least one voice frequency band (not illustrated) represents at least one frequency range in which human speech can be detected. For example, CPU 104 analyzes audio signal 204 in real-time to determine a level of voice activity 212 within a first voice band of 85-180 Hz (associated with speech of a typical adult male) and a second voice band of 165-255 Hz (associated with speech of a typical adult female). In one or more embodiments, CPU 104 compares the level of voice activity 212 to threshold 214. Threshold 214 establishes at least one predetermined threshold level of human speech. For example, threshold 214 may establish a volume level of 30 decibels (dB). In one embodiment, CPU 104 compares voice activity 212 to threshold 214 to determine whether a user that is proximate to electronic device 100 is currently speaking. In one embodiment, CPU 104 determines that a user proximate to electronic device 100 is currently speaking when voice activity 212 meets or exceeds threshold 214. CPU 104 determines that a user is not currently speaking when voice activity 212 does not meet or exceed threshold 214. For example, if voice activity 212 is determined to be 45 dB and threshold 214 is established as 30 decibels (dB), CPU 104 determines that a user proximate to electronic device 100 is currently speaking. In one embodiment, voice activity 212 may represent a peak audio level, a mean or average audio level, and/or a median audio level.

In another embodiment, at least one secondary microphone (which can be a physical microphone or virtual microphone) simultaneously receives other audio signal 205 during receiving of audio signal 204 by primary microphone 202. CPU 104 analyzes audio signal 204 and other audio signal 205 to determine a level of coherence 216. Coherence 216 represents a degree of agreement and/or consistency between audio signal 204 and other audio signal 205. A higher coherence value indicates a closer and/or louder vocal source and may indicate a presence of a user that is currently speaking. CPU 104 compares coherence 216 to coherence threshold 218. Coherence threshold 218 establishes at least one predetermined minimum coherence threshold, based on audio signal 204 received by primary microphone 202 and other audio signal 205 received by at least one secondary microphone. In one embodiment, CPU 104 determines that a user proximate to electronic device 100 is currently speaking when coherence 216 meets or exceeds coherence threshold 218. For example, if coherence 216 is determined to be 0.92 and coherence threshold 218 is 0.90, CPU 104 determines that a user proximate to electronic device 100 is currently speaking. In response to determining that a user that is proximate to the electronic device is currently speaking, CPU 104 may collectively process audio signal 204 with an existing composite signal 230 to generate modified audio signal 232 (as described in greater detail below).

In one or more embodiments, in response to determining that a user is not currently speaking, CPU 104 simultaneously receives audio 206*a-n* using a plurality of microphone subsets 210*a-n*. Each of microphone subset 210*a-n* includes primary microphone 202 and at least one secondary microphone from among microphones 108*a-n* (i.e., a microphone associated with electronic device 100 that is other than primary microphone 202) that is spatially separate from the microphone subset containing primary microphone 202. In one or more embodiments, a secondary microphone is not used in multiple microphone subsets 210*a-n* in order to ensure different audio is received by each subset and/or to ensure the coherence between primary microphone and the at least one secondary microphone is different for each subset. In the illustrated example, microphone 108*a* is primary microphone 202 and three microphone subsets 210*a-n* are provided. First microphone subset 210*a* includes primary microphone 202 and microphone 108*e*. Second microphone subset 210*b* includes primary microphone 202 and microphone 108*i*. Third microphone subset 210*n* includes primary microphone 202 and microphone 108*d*. Each of microphone subsets 210*a-n* concurrently receives audio 206*a-n*. Audio 206*a-n* contains audio simultaneously received by all microphones in that subset. In the illustrated example, microphone subset 210*a* receives audio 206*a*, microphone subset 210*b* receives audio 206*b*, and microphone subset 210*n* receives audio 206*n*.

CPU 104 analyzes each of audio 206*a-n* to determine at least one frequency band 208*a-n* having a high degree of correlation between microphones in a corresponding microphone subset 210*a-n*. In the illustrated example, CPU 104 analyzes audio 206*a-n* to determine a corresponding frequency band(s) 208*a-n*. The analysis of each of audio 206*a-n* enables CPU 104 to identify frequency bands 208*a-n* of high correlation. For example, frequency band(s) 208*a* may identify high correlation between 200-600 Hz, frequency band(s) 208*b* may identify high correlation between 500-700 Hz, and frequency band(s) 208*n* may identify high correlation between 40-90 Hz and 300-600 Hz. In one or more embodiments, CPU 104 can combine portions of audio 206*a-n* within frequency bands 208*a-n* to generate composite signal 230. Composite signal 230 only includes audio in frequency bands 208*a-n*. Thus, the coherence between the secondary microphones of each subset and primary microphone 202 is maximized within composite signal 230. Using the above example, composite signal 230 includes only audio between 40-90 Hz and 200-700 Hz.

CPU 104 can collectively process composite signal 230 and audio signal 204 to generate modified audio signal 232. Modified audio signal 232 is a real-time audio stream/recording that has a reduced level of noise over audio signal 204. In one embodiment, in collectively processing composite signal 230 and audio signal 204, CPU 104 suppresses, within audio signal 204, a level of noise in all audio bands (frequency bands 208*a-n*) included within composite signal 230. Using the above example, in collectively processing composite signal 230 and audio signal 204, CPU 104 suppresses noise in the 40-90 Hz and 200-700 Hz frequency bands of audio signal 204 to generate modified audio signal 232. In another embodiment, CPU 104 generates at least one noise cancellation signal (not illustrated) that is out of phase with all audio bands (frequency bands 208*a-n*) included within composite signal 230. CPU 104 collectively processes the at least one noise cancellation signal and audio signal 204 to cancel a level of noise in those audio bands included within composite signal 230 (i.e., frequency bands 208*a-n*) to generate modified audio signal 232. Using the above example, in collectively processing composite signal 230 and audio signal 204, CPU 104 cancels noise in the 40-90 Hz and 200-700 Hz frequency bands of audio signal 204 to generate modified audio signal 232. In other embodiments, CPU 104 can utilize linear-beamforming, blind beamforming, and/or other noise cancellation techniques that achieve similar results as substitutionary processes for generating the noise cancellation signal. It should also be noted that in one or more embodiments, CPU 104 can apply both suppression and noise cancellation processes to audio signal 204 based on composite signal 230. By determining frequency bands 208*a-n* during a time period in which a speaker of electronic device 100 is not currently speaking, audible background noise in environment 200 is filtered from modified audio signal 232. In one or more embodiments, in response to determining frequency bands 208*a-n* and/or calculating composite signal 230, CPU 104 continues suppressing/cancelling, within audio signal 204, audio within audio bands (frequency bands 208*a-n*) included within composite signal 230 after a user of electronic device 100 continues speaking. Thus, background noise that CPU 104 determines to exist in environment 200 during periods without speech can continued to be filtered from audio signal 204 while the user of electronic device is speaking. In another embodiment, in lieu of generating composite signal 230, CPU 104 can individually cancel and/or suppress noise in frequency ranges of audio signal 204 that correspond to frequency bands 208*a-n* to generate modified audio signal 232.

In response to generating modified audio signal 232, CPU 104 provides the modified audio signal 232 as an output. In one or more embodiments, modified audio signal 232 can be provided to a telecommunications device (e.g., radios 140*a-n*) for use as an outgoing voice signal for a cellular call, VOIP call, or any other type of voice-based electronic communication. In another embodiment, modified audio signal 232 can be provided to a speaker, such as a remote speaker (not illustrated).

In one or more embodiments, audio 206*a-n* is received only during time periods when it has been determined that a user proximate to electronic device 100 is not currently speaking (background noise in environment 200 may still exist). In this embodiment, composite signal 230 is continually updated only during time periods when a user proximate to electronic device 100 is not currently speaking. During time periods CPU 104 determines that a user proximate to electronic device 100 is currently speaking, CPU 104 can continue to collectively process a most recent composite signal 230 and detected/received audio signal 204 to generate modified audio signal 232. In response to determining that the user is no longer speaking, CPU 104 can continue to update composite signal 230.

In one or more embodiments, CPU 104 selects microphone subsets 210*a-n* from among a plurality of available subset combinations of microphones 108*a-n* to maximize noise reduction for primary microphone 202 during a communication between electronic device 100 and another device. In one or more embodiments, CPU 104 selects primary microphone 202 and microphone subsets 210*a-n* based on coherence measurements between a current primary microphone and other microphones of microphones 108*a-n* during time periods when it has been determined that a user proximate to electronic device 100 is not currently speaking. In another embodiment, CPU 104 selects primary microphone 202 and subsets 210*a-n* based on a current usage mode of electronic device 100. In a first example in which electronic device 100 is a cellular phone that is in a handset mode during a call, CPU 104 may select a microphone on a bottom surface of the cellular phone as primary microphone 202. In this example, CPU 104 may further select subsets 210*a-n* that incorporate the microphone on the bottom of the cellular phone (primary microphone 202) and at least one other microphone on another face of the phone. In another example in which electronic device 100 is a cellular phone that is in a speakerphone mode during a call, CPU 104 may select a microphone on a top surface of electronic device 100 that is furthest away from an output speaker as primary microphone 202. In this example, CPU 104 may further select subsets 210*a-n* that incorporate the microphone on the top surface of electronic device 100 (primary microphone 202) and at least one other microphone on another face of electronic device 100.

Figure 3:
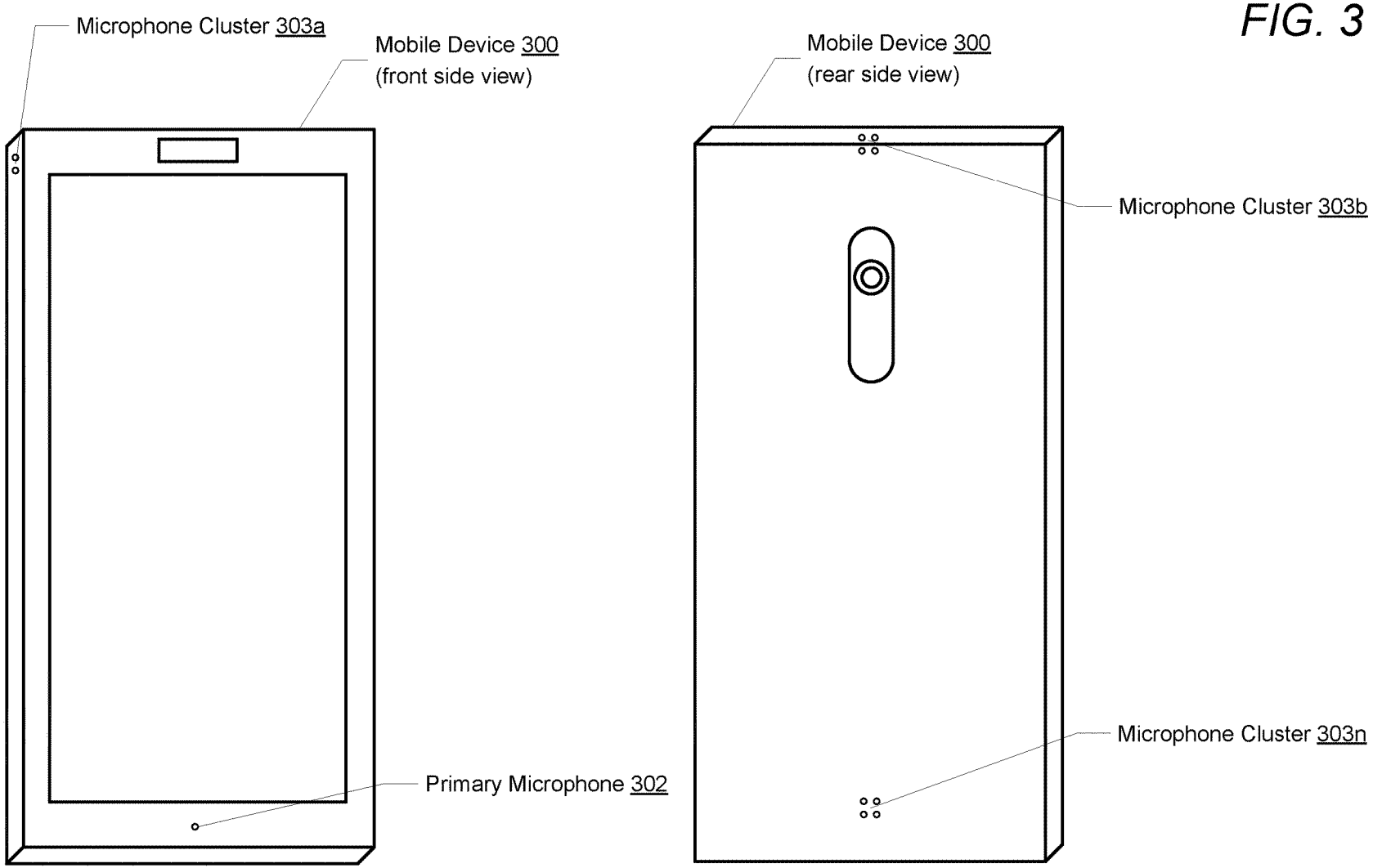
FIG. 3 illustrates another example mobile device, in accordance with one embodiment of the present disclosure.

Referring now to FIG. 3, there is illustrated another example mobile device, in accordance with one embodiment of the present disclosure. FIG. 3 illustrates a front-side view and a rear-side view of electronic device 300. The front side view of electronic device 300 includes first microphone cluster 303*a* is configured on a left side of mobile device 300 and includes two adjacent microphones. The rear side view of electronic device 300 includes second microphone cluster 303*b* and third microphone cluster 303*n*. Second microphone cluster 303*b* includes four adjacent microphones—two microphones on a top face of mobile device 300 and two microphones on a top of a rear face of mobile device 300. Third microphone cluster 303*n* is configured on a rear face of mobile device 300 and includes four adjacent microphones. In one or more embodiments, the clusters of microphones are arranged based on proximity and the microphones with the clusters may be spaced more closely together or further apart. It should also be noted that the elements illustrated in FIG. 3 have not necessarily been drawn to scale.

Figure 4:
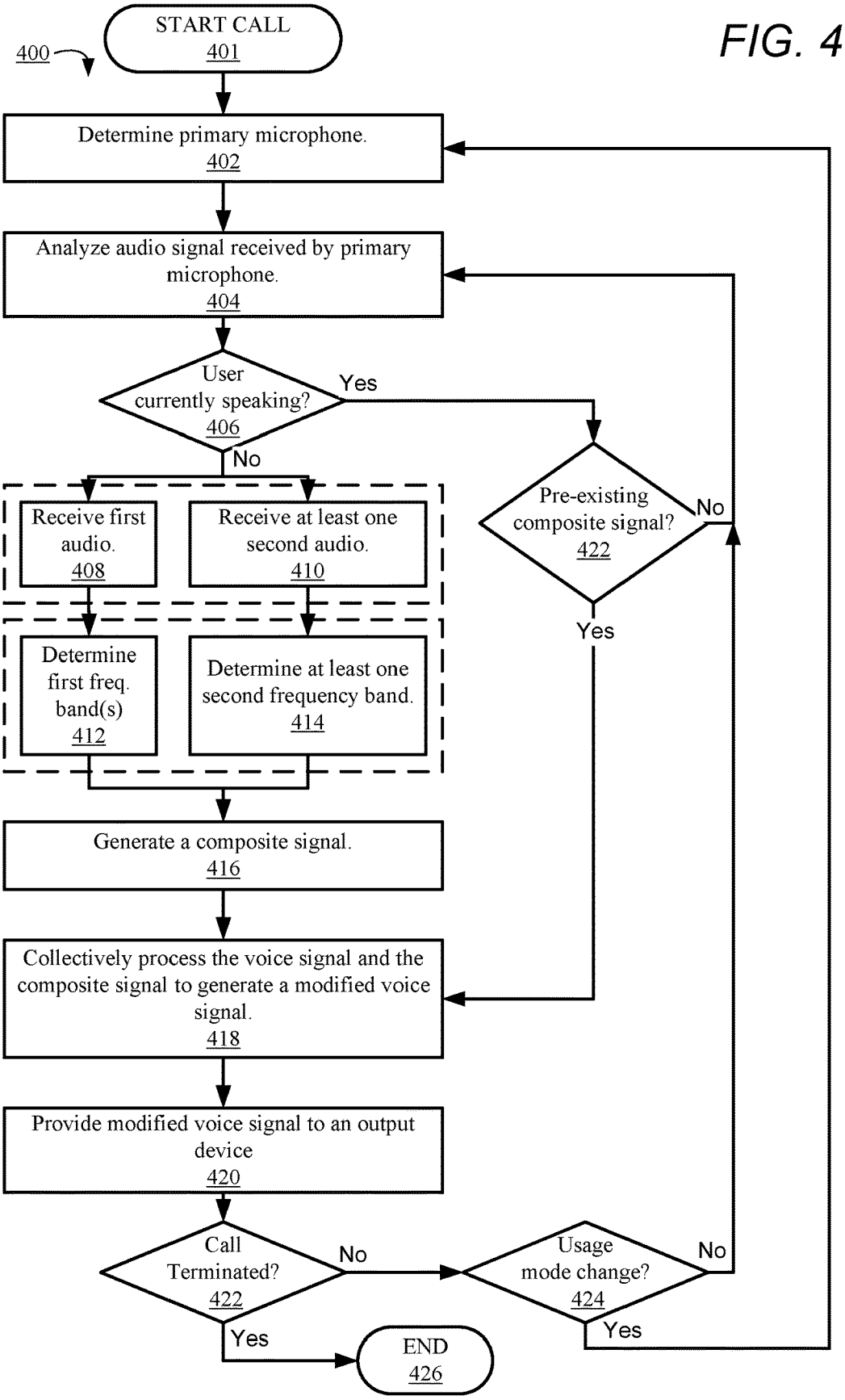
FIG. 4 is a flow chart illustrating a method for reducing noise in an audio signal, in accordance with one embodiment of the present disclosure.
Figure 5:
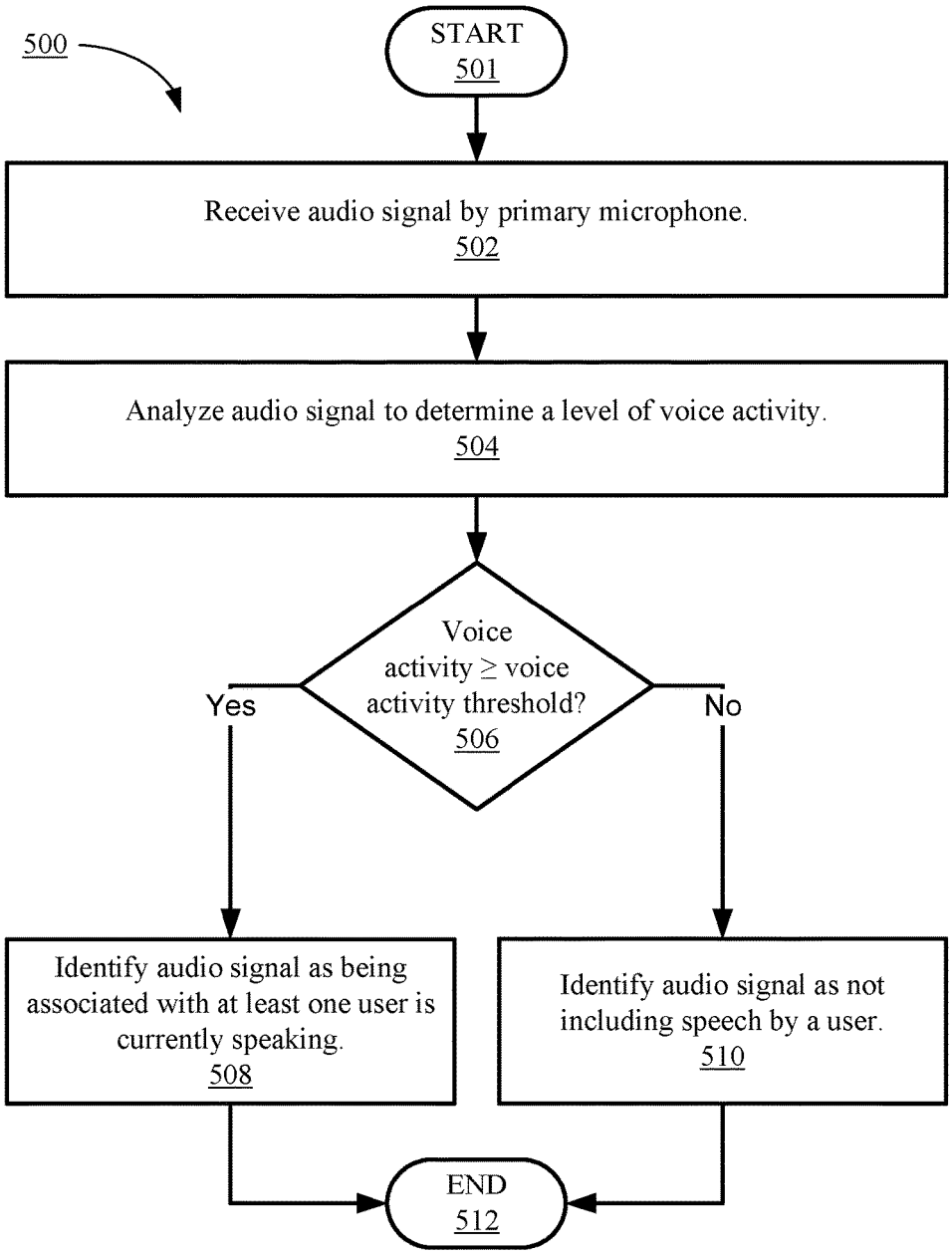
FIG. 5 is a flow chart illustrating a first method for analyzing audio received at an electronic device to determine whether at least one user of the electronic device is currently speaking, in accordance with one embodiment of the present disclosure.
Figure 6:
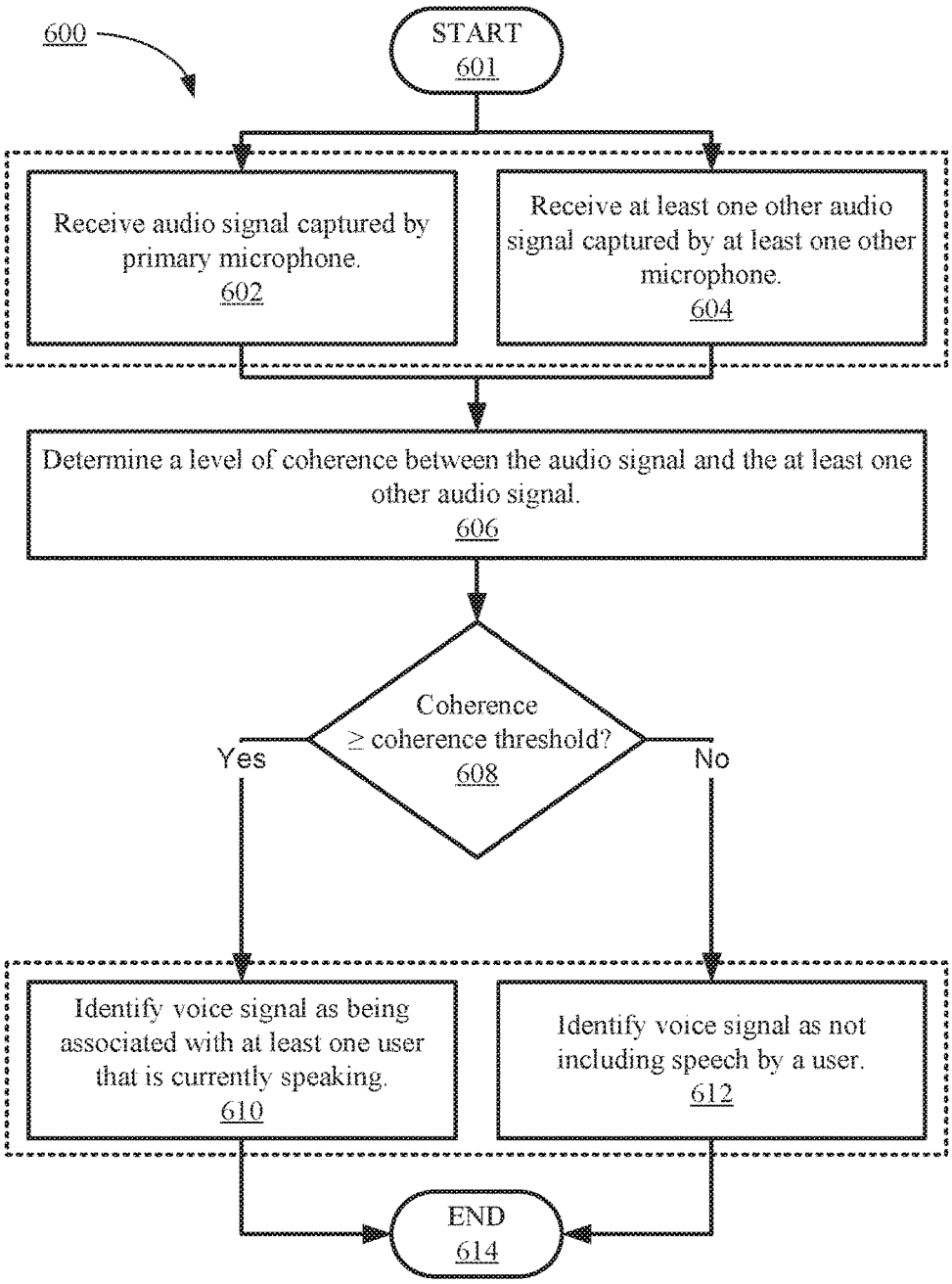
FIG. 6 is a flow chart illustrating a second method for analyzing audio received at an electronic device to determine whether at least one user of the electronic device is currently speaking, in accordance with another embodiment of the present disclosure.

Referring now to FIGS. 4-6, there are illustrated three different methods performed according to different embodiments. Aspects of the methods are described with reference to the components of FIGS. 1-3. Several of the processes of the methods provided in FIGS. 4-6 can be implemented by a processor (e.g., CPU 104) executing software code (i.e., program instructions) of NRU 117 within a device (e.g., electronic device 100). The method processes described in FIGS. 4-6 are generally described as being performed by components of electronic device 100.

Referring now to FIG. 4, there is depicted a flow chart illustrating a method for reducing noise in an audio signal received by at least one microphone, in accordance with at least one embodiment of the present disclosure. Method 400 commences at initiator block 401 where a call/communication commences. Method 400 then proceeds to block 402. At block 402, CPU 104 identifies/determines a primary microphone (e.g., primary microphone 202) of electronic device 100. The primary microphone may be manually selected by a user or may be automatically selected based on a current operating mode of electronic device 100. At block 404, CPU 104 analyzes an audio signal (e.g., audio signal 204) received by the primary microphone. At block 406, CPU 104 determines, based on the analysis of the audio signal, whether at least one user that is proximate to the electronic device is currently speaking.

At block 408, in response to determining at block 406 that a user is not currently speaking, CPU 104 receives a first audio (e.g., first audio 206*a*) by a first microphone subset (e.g., microphone subset 210*a*). At block 410, CPU 104 receives at least one second audio (e.g., audio 206*b-n*) via at least one second microphone subset (e.g., microphone subsets 210*b-n*). In one or more embodiments, steps 408 and 410 occur simultaneously or substantially concurrently. At block 412, CPU 104 determines, for the first microphone subset, at least one frequency band (e.g., frequency band(s) 208*a*) that has a high degree of correlation between microphones in the first microphone subset. At block 414, CPU 104 determines, for each second microphone subset, at least one frequency band (e.g., frequency band(s) 208*b-n*) that has a high degree of correlation between microphones in each corresponding second microphone subset. In one or more embodiments, steps 412 and 414 occur simultaneously or substantially concurrently. At block 416, CPU 104 combines portions of audio 206*a-n* within frequency bands 208*a-n* to generate a composite signal (e.g., composite signal 230). The coherence of the composite signal is maximized with the primary microphone. The composite signal includes audio in only those frequency bands having a high degree of correlation between microphones in each corresponding microphone subset. At block 418, CPU 104 collectively processes the audio signal and the composite signal to generate a modified audio signal (e.g., modified audio signal 232) having a reduced level of noise, versus the audio signal, in those frequency bands having the high degree of correlation. At block 420, the modified audio signal is provided to at least one output device.

At block 422, CPU 104 determines whether the call/communication has been terminated. In response to determining the call/communication has not been terminated, CPU 104 determines whether a current usage mode of the electronic device has changed (block 424). In response to determining the current usage mode of the electronic device has changed, method 400 continues back to block 402 and CPU 104 again determines the primary microphone. In response to determining the current usage mode of the electronic device has not changed, method 400 continues back to block 404 and CPU 104 continues analyzing audio content being received by primary microphone. In response to determining (at block 422) that the call/communication has been terminated, method 400 ends at block 426.

In response to determining at block 406 that at least one user that is proximate to the electronic device is currently speaking, CPU 104 determines whether a pre-existing composite signal exists (block 422). In response to determining that a pre-existing composite signal exists, method 400 continues to block 418 where the pre-existing composite signal and the audio signal are collectively processed to generate a modified audio signal (e.g., modified audio signal 232). In response to determining that a pre-existing composite signal does not exist, method 400 continues back to block 406 and CPU 104 again analyzes the audio signal to determine whether at least one user that is proximate to the electronic device is still currently speaking.

Referring now to FIG. 5, there is depicted a flow chart illustrating a first method for analyzing a received audio signal to determine whether at least one user that is proximate to electronic device 100 is currently speaking, in accordance with one embodiment of the present disclosure. In one or more embodiments, the features and/or functionality provided by method 500 may be performed at steps 404-406 of method 400 (as described in FIG. 4, above). Method 500 commences at initiator block 501 then proceeds to block 502. At block 502, a primary microphone (e.g., primary microphone 202) of an electronic device (e.g., electronic device 100) receives an audio signal (e.g., audio signal 204). At block 504, CPU 104 analyzes the received audio signal to determine a level of voice activity (e.g., voice activity 212) within at least one frequency range/band. At block 506, CPU 104 determines whether the determined level of voice activity meets or exceeds at least one voice activity threshold (e.g., threshold 214). In response to determining at block 506 that the level of voice activity meets or exceeds the at least one voice activity threshold, method 500 continues to block 508. At block 508, CPU 104 identifies the audio signal as being associated with at least one user that is currently speaking. In response to determining at block 506 that the level of voice activity does not meet or exceed the at least one voice activity threshold, CPU 104 identifies the audio signal as not including speech by a user that is proximate to electronic device 100 (block 510). Method 500 then ends at block 512.

Referring now to FIG. 6, there is depicted a flow chart illustrating a second method for analyzing a received audio signal to determine whether at least one user of the electronic device is currently speaking, in accordance with another embodiment of the present disclosure. In one or more embodiments, the features and/or functionality provided by method 600 may be performed at steps 404-406 of method 400 (as described in FIG. 4, above). Method 600 commences at initiator block 601, then proceeds to block 602. At block 602, a primary microphone (e.g., primary microphone 202) of an electronic device (e.g., electronic device 100) receives, as an input, an audio signal (e.g., audio signal 204). At block 604, at least one secondary microphone of the electronic device receives, as an input, at least one other audio signal (e.g., audio signal 205). In one or more embodiments, steps 602 and 604 occur simultaneously or substantially concurrently. At block 606, CPU 104 analyzes the audio signal (e.g., audio signal 204) and the at least one other audio signal (e.g., audio signal 205) to determine a level of coherence (e.g., coherence 216) between the audio signal and the at least one other audio signal. In one embodiment, CPU 104 performs a spectral analysis of the audio signal and the at least one other audio signal. In this embodiment, CPU 104 compares the spectral analysis of the audio signal and the at least one other audio signal and scores the level of agreement/consistency between the audio signal and the at least one other audio signal as the level of coherence. A higher coherence value for the level of coherence indicates a closer and/or louder vocal source and may also indicate a presence of a user that is currently speaking. At block 608, CPU 104 determines whether the level of coherence meets or exceeds at least one coherence threshold (e.g., coherence threshold 218). The coherence threshold establishes at least one predetermined minimum coherence threshold value which indicates the presence of a proximate speaker.

In response to determining at block 608 that the level of coherence meets or exceeds the at least one coherence threshold, CPU 104 identifies the audio signal (e.g., audio signal 204) as being associated with at least one user that is currently speaking (block 610). In response to determining at block 608 that the level of coherence does not meet or exceed the at least one coherence threshold, CPU 104 identifies the audio signal as not including speech by a user (block 612). Method 600 then ends at block 614.

In the above-described flow charts of FIG. 4-6, one or more of the method processes may be embodied in a computer readable device containing computer readable code such that a series of steps are performed when the computer readable code is executed on a computing device. In some implementations, certain steps of the methods are combined, performed simultaneously or in a different order, or perhaps omitted, without deviating from the scope of the disclosure. Thus, while the method steps are described and illustrated in a particular sequence, use of a specific sequence of steps is not meant to imply any limitations on the disclosure. Changes may be made with regards to the sequence of steps without departing from the spirit or scope of the present disclosure. Use of a particular sequence is therefore, not to be taken in a limiting sense, and the scope of the present disclosure is defined only by the appended claims.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. Computer program code for carrying out operations for aspects of the present disclosure may be written in any combination of one or more programming languages, including an object-oriented programming language, without limitation. These computer program instructions may be provided to a processor of a general-purpose computer, special-purpose computer, or other programmable data processing apparatus to produce a machine that performs the method for implementing the functions/acts specified in the flowchart and/or block diagram block or blocks. The methods are implemented when the instructions are executed via the processor of the computer or other programmable data processing apparatus.

As will be further appreciated, the processes in embodiments of the present disclosure may be implemented using any combination of software, firmware, or hardware. Accordingly, aspects of the present disclosure may take the form of an entirely hardware embodiment or an embodiment combining software (including firmware, resident software, micro-code, etc.) and hardware aspects that may all generally be referred to herein as a "circuit," "module," or "system." Furthermore, aspects of the present disclosure may take the form of a computer program product embodied in one or more computer readable storage device(s) having computer readable program code embodied thereon. Any combination of one or more computer readable storage device(s) may be utilized. The computer readable storage device may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage device can include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage device may be any tangible medium that can contain, or store a program for use by or in connection with an instruction execution system, apparatus, or device.

Where utilized herein, the terms "tangible" and "non-transitory" are intended to describe a computer-readable storage medium (or "memory") excluding propagating electromagnetic signals; but are not intended to otherwise limit the type of physical computer-readable storage device that is encompassed by the phrase "computer-readable medium" or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

While the disclosure has been described with reference to example embodiments, it will be understood by those skilled in the art that various changes may be made and equivalents may be substituted for elements thereof without departing from the scope of the disclosure. In addition, many modifications may be made to adapt a particular system, device, or component thereof to the teachings of the disclosure without departing from the scope thereof. Therefore, it is intended that the disclosure not be limited to the particular embodiments disclosed for carrying out this disclosure, but that the disclosure will include all embodiments falling within the scope of the appended claims.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A method comprising:

determining, from an audio signal received by at least one primary microphone of an electronic device, whether a user that is proximate to the electronic device is currently speaking;

in response to determining that a user is not currently speaking:

receiving a first audio using a first microphone subset from among a plurality of microphones, the first microphone subset including the at least one primary microphone and at least one first microphone;

receiving at least one second audio using at least one second microphone subset from among the plurality of microphones, the second microphone subset including the at least one primary microphone and at least one second microphone, wherein the at least one first microphone and the at least one second microphone are spatially separate;

generating a composite signal from the first audio and the second audio; and collectively processing the audio signal and the composite signal to generate a modified audio signal having a reduced level of noise.

2. The method of claim 1, wherein generating the composite signal further comprises:

analyzing the first audio to determine at least one first frequency band having a high degree of correlation between microphones of the first microphone subset;

analyzing the at least one second audio to determine at least one second frequency band having a high degree of correlation between microphones of the at least one second microphone subset; and combining the at least one first frequency band and the at least one second frequency band to generate the composite signal, wherein the composite signal includes only audio in the at least one first frequency band and the at least one second frequency band.

3. The method of claim 2, wherein generating the composite signal further comprises:

generating, as the composite signal, at least one noise cancellation signal that is out of phase with the at least one first frequency band and the at least one second frequency band; and wherein collectively processing the audio signal and the composite signal cancels a level of noise in at least one frequency band of the audio signal that corresponds to the at least one first frequency band and the at least one second frequency band.

4. The method of claim 2, wherein collectively processing the audio signal and the composite signal further comprises:

suppressing a level of noise in at least one frequency band of the audio signal that corresponds to the at least one first frequency band and the at least one second frequency band.

5. The method of claim 1, wherein determining whether the user is currently speaking further comprises:

analyzing the audio signal to determine a level of voice activity within at least one voice band;

comparing the level of voice activity to at least one predetermined threshold, wherein a level of voice activity that meets or exceeds the at least one predetermined threshold indicates a presence of a user that is currently speaking.

6. The method of claim 1, wherein determining whether the user is currently speaking further comprises:

analyzing the audio signal to determine a level of coherence between the audio signal and at least one other audio signal simultaneously received by at least one other microphone of the plurality of microphones; and comparing the level of coherence to at least one predetermined coherence threshold, wherein a level of coherence that meets or exceeds the at least one predetermined coherence threshold indicates a presence of a user that is currently speaking.

7. The method of claim 1, wherein the first audio and the second audio are received during at least one time period when the user is not currently speaking.

8. An electronic device comprising:

at least one primary microphone that receives an audio signal;

at least one processor that determines, from the audio signal, whether a user of the electronic device is currently speaking; and a plurality of microphones comprising:

a first microphone subset includes the at least one primary microphone and at least one first microphone and which receives a first audio in response to determining that a near-end speaker is not currently speaking; and at least one second microphone subset that includes the at least one primary microphone and at least one second microphone and which receives at least one second audio in response to determining that a near-end speaker is not currently speaking, wherein the at least one first microphone and the at least one second microphone are spatially separate; and wherein the at least one processor:

receives the first audio from the first microphone subset and the second audio from the second microphone subset;

generates a composite signal from the first audio and the second audio; and collectively processes the audio signal and the composite signal to generate a modified audio signal having a reduced level of noise.

9. The electronic device of claim 8, wherein in generating the composite signal, the at least one processor:

analyzes the first audio to determine at least one first frequency band having a high degree of correlation between microphones of the first microphone subset;

analyzes the at least one second audio to determine at least one second frequency band having a high degree of correlation between microphones of the at least one second microphone subset; and combines the at least one first frequency band and the at least one second frequency band to generate the composite signal, wherein the composite signal includes only audio in the at least one first frequency band and the at least one second frequency band.

10. The electronic device of claim 9, wherein in generating the composite, the at least one processor:

generates, as the composite signal, at least one noise cancellation signal that is out of phase with the at least one first frequency band and the at least one second frequency band; and collectively processing the audio signal and the composite signal cancels a level of noise in at least one frequency band of the audio signal that corresponds to the at least one first frequency band and the at least one second frequency band.

11. The electronic device of claim 9, wherein in collectively processing the audio signal and the composite signal, the at least one processor:

suppresses a level of noise in at least one frequency band of the audio signal that corresponds to the at least one first frequency band and the at least one second frequency band.

12. The electronic device of claim 8, wherein in determining whether the user is currently speaking, the at least one processor:

analyzes the audio signal to determine a level of voice activity within at least one voice band;

compares the level of voice activity to at least one predetermined threshold, wherein a level of voice activity that meets or exceeds the at least one predetermined threshold indicates a presence of a user that is currently speaking.

13. The electronic device of claim 8, wherein in determining whether the user is currently speaking, the at least one processor:

analyzes the audio signal to determine a level of coherence between the audio signal and at least one other audio signal simultaneously received by at least one other microphone of the plurality of microphones; and compares the level of coherence to at least one predetermined coherence threshold, wherein a level of coherence that meets or exceeds the at least one predetermined coherence threshold indicates a presence of a user that is currently speaking.

14. The electronic device of claim 8, wherein the first audio and the second audio are received during at least one time period when the user is not currently speaking.

15. A computer program product comprising:

a computer readable storage device; and program code on the computer readable storage device that, when executed by a processor associated with an electronic device, enables the electronic device to provide the functionality of:

determining, from an audio signal received by at least one primary microphone of an electronic device, whether a user that is proximate to the electronic device is currently speaking;

in response to determining that a user is not currently speaking:

receiving a first audio using a first microphone subset from among a plurality of microphones, the first microphone subset including the at least one primary microphone and at least one first microphone;

receiving at least one second audio using at least one second microphone subset from among the plurality of microphones, the second microphone subset including the at least one primary microphone and at least one second microphone, wherein the at least one first microphone and the at least one second microphone are spatially separate;

generating a composite signal from the first audio and the second audio; and collectively processing the audio signal and the composite signal to generate a modified audio signal having a reduced level of noise.

16. The computer program product of claim 15, the program code for generating the composite signal further comprising code for:

analyzing the first audio to determine at least one first frequency band having a high degree of correlation between microphones of the first microphone subset;

analyzing the at least one second audio to determine at least one second frequency band having a high degree of correlation between microphones of the at least one second microphone subset; and combining the at least one first frequency band and the at least one second frequency band to generate the composite signal, wherein the composite signal includes only audio in the at least one first frequency band and the at least one second frequency band.

17. The computer program product of claim 15, the program code for determining whether the user is currently speaking further comprising code for:

analyzing the audio signal to determine a level of coherence between the audio signal and at least one other audio signal simultaneously received by at least one other microphone of the plurality of microphones; and comparing the level of coherence to at least one predetermined coherence threshold, wherein a level of coherence that meets or exceeds the at least one predetermined coherence threshold indicates a presence of a user that is currently speaking.

18. The computer program product of claim 15, wherein the first audio and the second audio are received during at least one time period when the user is not currently speaking.

* * * * *